US008439702B2

(12) United States Patent
Dietz et al.

(10) Patent No.: US 8,439,702 B2
(45) Date of Patent: May 14, 2013

(54) HIGH DENSITY JACK

(75) Inventors: William H. Dietz, Branford, CT (US); Kenneth A. Cupples, Pawcatuck, CT (US); Richard W. Schlueter, Clinton, CT (US)

(73) Assignee: Ortronics, Inc., New London, CT (US)

( * ) Notice: Subject to any disclaimer, the term of this patent is extended or adjusted under 35 U.S.C. 154(b) by 128 days.

(21) Appl. No.: 12/889,996

(22) Filed: Sep. 24, 2010

(65) Prior Publication Data

US 2012/0077375 A1 Mar. 29, 2012

(51) Int. Cl.
*H01R 13/73* (2006.01)

(52) U.S. Cl.
USPC ..... 439/545; 439/536

(58) Field of Classification Search ..... 439/545, 439/548, 549, 536
See application file for complete search history.

(56) References Cited

U.S. PATENT DOCUMENTS 4,077,693 A * 3/1978 Briel et al. ..... 439/545
5,125,852 A 6/1992 Archer
6,312,285 B1 * 11/2001 Berg et al. ..... 439/545
6,461,052 B1 10/2002 Hines et al.
6,945,816 B1 * 9/2005 Wu ..... 439/545
6,960,099 B2 * 11/2005 McAlonis ..... 439/545
7,192,307 B1 * 3/2007 Tran et al. ..... 439/553
7,575,472 B1 * 8/2009 Wu ..... 439/545
7,651,350 B1 * 1/2010 Wu ..... 439/153
2010/0159752 A1 6/2010 Siev et al.

OTHER PUBLICATIONS

PCT International Search Report and Written Opinion dated Jan. 6, 2012.

* cited by examiner

*Primary Examiner* — Hien Vu
(74) *Attorney, Agent, or Firm* — McCarter & English, LLP

(57) ABSTRACT

The present disclosure provides for electrical connectors or jack assemblies/housings for use in voice/data communication systems. More particularly, the present disclosure provides for modular jack assemblies that include a movable locking member. The present disclosure provides for improved systems/designs for jack assemblies/housings that are easily secured and/or unsecured to or from a jack panel or jack faceplate. In exemplary embodiments, the present disclosure provides for convenient, low-cost and effective systems and methods for easily securing and/or unsecuring jack assemblies/housings to or from a jack panel/faceplate (e.g., in the field) by utilizing advantageous modular jack assemblies that include a movable locking member, and related assemblies.

29 Claims, 5 Drawing Sheets

HIGH DENSITY JACK

BACKGROUND

1. Technical Field

The present disclosure generally relates to electrical connectors or jack assemblies/housings for use in voice/data communication systems and, more particularly, to modular jack assemblies that include a movable locking member.

2. Background Art

In general, devices for interfacing with high frequency data transfer media are known. For example, electrical connectors or jack assemblies/housings having a plurality of contacts (e.g., modular communication jacks) have been developed that facilitate electrical interface and communication with contacts in connecting assemblies (e.g., plug connectors), that in turn interact with various media (e.g., unshielded twisted pair (UTP) media, fiber optic cables, etc.). The jack housing contacts are typically positioned for electrical communication with data signal transmission media plug elements/contacts introduced to a receiving space of the jack housing. In general, UTP media is a flexible, low cost media having widespread application in voice and/or data communications. Moreover, the standard modular jack housing is typically configured and dimensioned in compliance with the FCC part 68.500 standard which provides compatibility and matability between various media manufacturers.

In general, many data transfer media includes multiple pairs of lines bundled together. Communications systems typically incorporate many such media (e.g., UTP media) and connectors (e.g., jack/plug combinations) for data transfer. For example, a plurality of jack assemblies/housings may be positioned adjacent one another in a multi-gang jack panel or the like, with each jack assembly/housing releasably secured and/or attached to the jack panel or the like. Alternatively, a single jack assembly/housing or a plurality of jack assemblies/housings may be releasably secured to a jack faceplate (e.g., secured to a bezel associated with a single-gang or multi-gang jack faceplate).

In general, it is desirable to have jack assemblies/housings that are easily secured/attached or unsecured/unattached to or from a jack panel or jack faceplate. For example, operators or technicians are frequently confronted with the need to secure or unsecure jack assemblies/housings to or from jack panels/faceplates under difficult conditions (e.g., in tight and/or limited work spaces; next to and/or adjacent to multiple adjacent jack assemblies/housings, media, connectors/plug combinations, etc.).

However, current practice provides that it can be very difficult and time consuming for an operator or technician to secure/attach or unsecure/unattach conventional jack assemblies/housings to or from existing jack panels/faceplates. For example, with existing systems/methods, an operator typically is required to manually force, push, torque and/or move the jack assembly/housing into or out of the jack panel/faceplate to secure/attach or unsecure/unattach the jack assembly/housing to or from the jack panel/faceplate. Such procedures can be very difficult and time consuming, especially when the jack assembly/housing to be attached/unattached is located in a tight and/or limited workspace, and/or when it is next to and/or adjacent to multiple adjacent jack assemblies/housings, media, connectors/plug combinations, etc.

Thus, despite efforts to date, a need remains for improved systems/designs for jack assemblies/housings that are easily secured and/or unsecured to or from a jack panel or jack faceplate. These and other inefficiencies and opportunities for improvement are addressed and/or overcome by the systems, assemblies and methods of the present disclosure.

SUMMARY

The present disclosure provides for improved electrical connectors or jack assemblies/housings for use in voice/data communication systems. More particularly, the present disclosure provides for advantageous modular jack assemblies that include a movable locking member. In general, the present disclosure provides for improved systems/designs for jack assemblies/housings that are easily secured and/or unsecured to or from a jack panel or jack faceplate. In exemplary embodiments, the present disclosure provides for improved, convenient, low-cost and effective systems and methods for easily securing and/or unsecuring jack assemblies/housings to or from a jack panel/faceplate (e.g., in the field) by utilizing advantageous modular jack assemblies that include a movable locking member, and related assemblies.

The present disclosure provides for an electrical connector assembly including a housing defining a front side; a movable locking member releasably secured to the housing; wherein the movable locking member is configured and dimensioned to be moved away from the front side to allow the housing to be moved to a first position within a receiving cavity of a receiver member; wherein the movable locking member is configured and dimensioned to be moved towards the front side of the housing to removably lock the housing within the receiving cavity after the housing has moved to a second position within the receiving cavity.

The present disclosure also provides for an electrical connector assembly wherein the front side further includes a first flange extending from the front side and the receiver member further includes a first projection, the first flange configured and dimensioned to bypass the first projection when the housing is moved to the first position; and wherein the first flange is lockingly engaged with the first projection when the housing is in the second position. The present disclosure also provides for an electrical connector assembly wherein the housing further includes left and right sides, the left and right sides each including a groove; and wherein the receiver member further includes first and second projections, the first projection positioned in the right side groove and the second projection positioned in the left side groove when the housing is in the first position.

The present disclosure also provides for an electrical connector assembly wherein the first and second projections travel within the right and left side grooves when the housing is moved from the first position to the second position. The present disclosure also provides for an electrical connector assembly wherein the front side of the housing further includes a second flange extending from the front side and the receiver member further includes a second projection; and wherein the second flange is positioned to bypass the second projection when the housing is in the first position; and wherein the second flange is lockingly engaged with the second projection when the housing is in the second position.

The present disclosure also provides for an electrical connector assembly wherein the front side of the housing further includes a third flange and a fourth flange extending from the front side and the receiver member further includes a third projection and a fourth projection; and wherein the third flange is positioned to bypass the third projection and the fourth flange is positioned to bypass the fourth projection when the housing is in the first position; and wherein the third flange is lockingly engaged with the third projection and the fourth flange is lockingly engaged with the fourth projection when the housing is in the second position.

The present disclosure also provides for an electrical connector assembly wherein the housing further includes a top side and the movable locking member is releasably secured to the top side of the housing. The present disclosure also provides for an electrical connector assembly wherein the top side includes a first and second rails and the movable locking member includes first and second rail extensions; and wherein the movable locking member is releasably secured to the housing by inserting the first and second rail extensions into the first and second rails. The present disclosure also provides for an electrical connector assembly wherein the movable locking member moves via the rail extensions moving with respect to the first and second rails.

The present disclosure also provides for an electrical connector assembly wherein the front side of the housing and the movable locking member are substantially flush after the movable locking member has moved towards the front side of the housing to removable lock the housing within the receiving cavity. The present disclosure also provides for an electrical connector assembly wherein the movable locking member further includes a locking head and first and second locking tabs, the locking head and first and second locking tabs lockingly engaged with the receiver member after the movable locking member has moved towards the front side of the housing to removable lock the housing within the receiving cavity.

The present disclosure also provides for an electrical connector assembly wherein the housing is a high density modular communication jack housing that defines a receiving space, the receiving space adapted to receive signals from a connecting assembly inserted into the receiving space. The present disclosure also provides for an electrical connector assembly wherein the receiver member is a bezel, the bezel configured and dimensioned to be positioned in a faceplate or workstation outlet. The present disclosure also provides for an electrical connector assembly wherein the housing is a jack housing and the receiver member is a bezel, the bezel having a plurality of receiving cavities, each receiving cavity configured and dimensioned to releasably secure a jack housing. The present disclosure also provides for an electrical connector assembly wherein the housing is a jack housing and the receiver member is a panel member, the panel member having a plurality of receiving cavities, each receiving cavity configured and dimensioned to releasably secure a jack housing.

The present disclosure also provides for an electrical connector assembly wherein the movable locking member is elongated having an elongated proximal end. The present disclosure also provides for an electrical connector assembly wherein the elongated proximal end includes at least one cable management element or a cable strain relief member. The present disclosure also provides for an electrical connector assembly wherein the elongated proximal end includes gripping material or coating. The present disclosure also provides for an electrical connector assembly wherein the movable locking member defines a portion of the housing.

The present disclosure also provides for an electrical connector assembly wherein the housing further includes a left side, right side and a bottom side, and the first flange extends: (i) sideways outwardly past the left or right side, and (ii) downwardly below the bottom side. The present disclosure also provides for an electrical connector assembly wherein the housing further includes a left side and a right side, and the second flange extends sideways outwardly past the left or right side. The present disclosure also provides for an electrical connector assembly wherein a tab of the movable locking member releasably engages a recess of the housing when the movable locking member is moved to the front side of the housing to removably lock the housing within the receiving cavity.

The present disclosure also provides for a method for removably locking an electrical connector assembly including providing a housing defining a front side; releasably securing a movable locking member to the housing; moving the movable locking member away from the front side of the housing; moving the housing to a first position within a receiving cavity of a receiver member; moving the housing to a second position within the receiving cavity; and moving the movable locking member towards the front side of the housing to removably lock the housing within the receiving cavity.

The present disclosure also provides for a method for removably locking an electrical connector assembly wherein the front side further includes a first flange extending from the front side and the receiver member further includes a first projection, the first flange positioned to bypass the first projection when the housing is moved to the first position; and wherein the first flange is lockingly engaged with the first projection when the housing is in the second position.

The present disclosure also provides for a method for removably locking an electrical connector assembly wherein housing further includes left and right sides, the left and right sides each including a groove; and wherein the receiver member further includes second and third projections, the second projection positioned in the right side groove and the third projection positioned in the left side groove when the housing is in the first position.

The present disclosure also provides for a method for removably locking an electrical connector assembly wherein the second and third projections travel within the right and left side grooves when the housing is moved from the first position to the second position. The present disclosure also provides for a method for removably locking an electrical connector assembly wherein the front side of the housing further includes a second flange extending from the front side and the receiver member further includes a second projection; and wherein the second flange is positioned to bypass the second projection when the housing is in the first position; and wherein the second flange is lockingly engaged with the second projection when the housing is in the second position.

The present disclosure also provides for a method for removably locking an electrical connector assembly wherein the front side of the housing further includes a third flange and a fourth flange extending from the front side and the receiver member further includes a third projection and a fourth projection; and wherein the third flange is positioned to bypass the third projection and the fourth flange is positioned to bypass the fourth projection when the housing is in the first position; and wherein the third flange is lockingly engaged with the third projection and the fourth flange is lockingly engaged with the fourth projection when the housing is in the second position.

The present disclosure also provides for a method for removably locking an electrical connector assembly wherein the housing further includes a top side and the movable locking member is releasably secured to the top side of the housing. The present disclosure also provides for a method for removably locking an electrical connector assembly wherein the top side includes a first and second rails and the movable locking member includes first and second rail extensions; and wherein the movable locking member is releasably secured to the housing by inserting the first and second rail extensions into the first and second rails. The present disclosure also provides for a method for removably locking an electrical connector assembly wherein the movable locking member moves via the rail extensions moving with respect to the first and second rails.

The present disclosure also provides for a method for removably locking an electrical connector assembly wherein the front side of the housing and the movable locking member are substantially flush after the movable locking member has moved towards the front side of the housing to removable lock the housing within the receiving cavity.

The present disclosure also provides for a method for removably locking an electrical connector assembly wherein the movable locking member further includes a locking head and first and second locking tabs, the locking head and first and second locking tabs lockingly engaged with the receiver member after the movable locking member has moved towards the front side of the housing to removable lock the housing within the receiving cavity.

The present disclosure also provides for a method for removably locking an electrical connector assembly wherein the housing is a high density modular communication jack housing that defines a receiving space, the receiving space adapted to receive signals from a connecting assembly inserted into the receiving space. The present disclosure also provides for a method for removably locking an electrical connector assembly wherein a tab of the movable locking member releasably engages a recess of the housing when the movable locking member is moved to the front side of the housing to removably lock the housing within the receiving cavity.

The present disclosure also provides for an electrical connector assembly including a housing defining a front side, left side and right side, the front side including a first flange extending from the front side and the left and right sides each including a groove; a movable locking member releasably secured to the housing; wherein the movable locking member is configured and dimensioned to be moved away from the front side to allow the housing to be moved to a first position within a receiving cavity of a receiver member, the receiver member having a first projection, a second projection and a third projection, the first flange configured and dimensioned to bypass the first projection when the housing is moved to the first position and the second projection positioned in the right side groove and the third projection positioned in the left side groove when the housing is in the first position; wherein the movable locking member is configured and dimensioned to be moved towards the front side of the housing to removably lock the housing within the receiving cavity after the housing has moved towards the first projection to a second position within the receiving cavity, the first flange lockingly engaged with the first projection when the housing is in the second position to prevent the housing from being removed from the receiving cavity.

The present disclosure also provides for an electrical connector assembly wherein the second and third projections travel within the right and left side grooves when the housing is moved from the first position to the second position.

Additional advantageous features, functions and applications of the disclosed systems, assemblies and methods of the present disclosure will be apparent from the description which follows, particularly when read in conjunction with the appended figures.

BRIEF DESCRIPTION OF THE DRAWINGS

To assist those of ordinary skill in the art in making and using the disclosed systems, assemblies and methods, reference is made to the appended figures, wherein.

DETAILED DESCRIPTION

Figure 1:
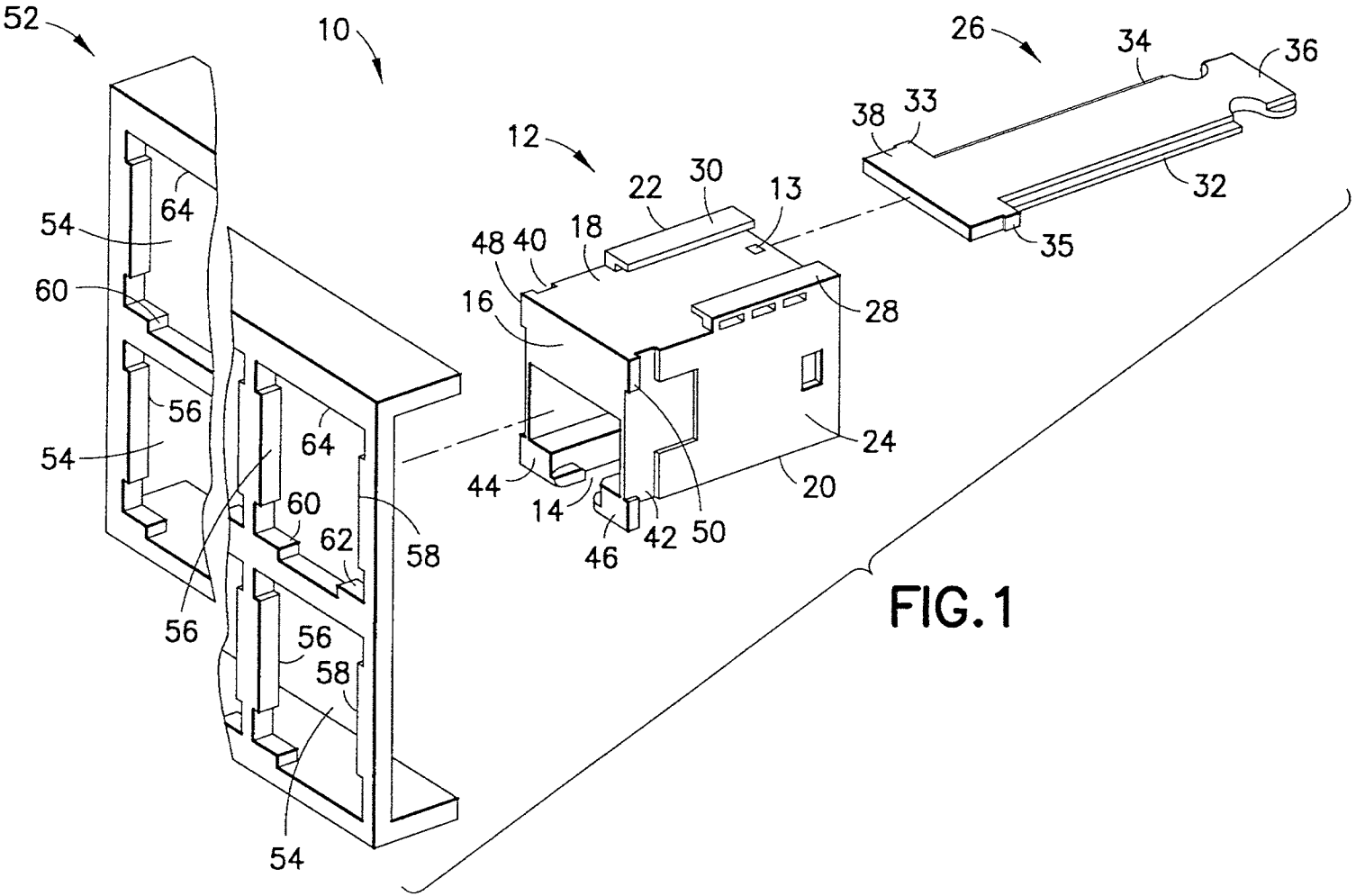
FIG. 1 is a side perspective view of an electrical connector assembly in accordance with an exemplary embodiment of the present disclosure, prior to assembly.

In the description which follows, like parts are marked throughout the specification and drawings with the same reference numerals, respectively. Drawing figures are not necessarily to scale and in certain views, parts may have been exaggerated for purposes of clarity.

The present disclosure provides for advantageous jack assemblies/housings for use in voice/data communication systems. More particularly, the present disclosure provides for improved systems/designs for jack assemblies/housings that are easily secured and/or unsecured to or from a jack panel or jack faceplate. In exemplary embodiments, the present disclosure provides for improved, convenient, low-cost and effective systems and methods for easily securing and/or unsecuring jack assemblies/housings to or from a jack panel/faceplate (e.g., in the field) by utilizing advantageous modular jack assemblies that include a movable locking member, and related assemblies.

Current practice provides that it is very difficult and time consuming for an operator or technician to secure/attach or unsecure/unattach conventional jack assemblies/housings to or from existing jack panels/faceplates, especially when the jack assembly/housing to be attached or unattached is located in a tight and/or limited workspace, and/or when it is next to and/or adjacent to multiple adjacent jack assemblies/housings, media, connectors/plug combinations, etc. In exemplary embodiments, the present disclosure provides for convenient, low-cost and effective systems/designs for jack assemblies/housings that are easily secured and/or unsecured to or from a jack panel or jack faceplate, thereby providing a significant manufacturing and commercial advantage as a result.

Referring now to the drawings, there is illustrated an exemplary electrical connector assembly or modular jack assembly 10. In general, electrical connector assembly 10 includes a jack housing 12 (e.g., high density modular communication jack housing) that is adapted to receive signals from a mating connecting assembly (e.g., a plug connector, such as an RJ-45 plug or an IEC 60603-7-7 compliant plug) inserted or introduced to a receiving space 14 of jack housing 12. As such, associated contacts (e.g., eight contacts) or the like of jack housing 12 are positioned for electrical communication with data signal transmission media plug elements/contacts introduced to the receiving space 14 of jack housing 12. In general, jack housing 12 is suitable for use in various applications, e.g., for interfacing with high frequency data transfer media, connection to data transfer devices or the like, etc. For example, jack housing 12 may be mounted to a printed circuit board (PCB) and signals may transfer from a plug connector introduced to receiving space 14 to the PCB and then to insulation displacement contacts (IDCs), thus completing the data interface and transfer through assembly 10.

Figure 3:
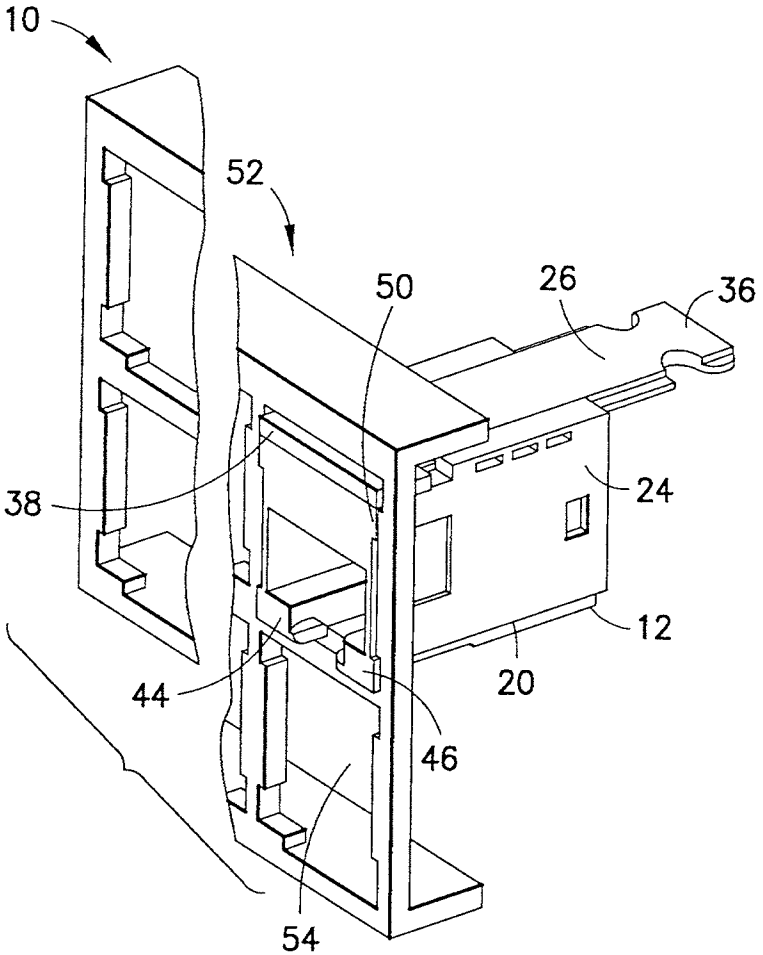
FIG. 3 is a side perspective view of the electrical connector assembly of FIG. 1, after assembly.
Figure 2:
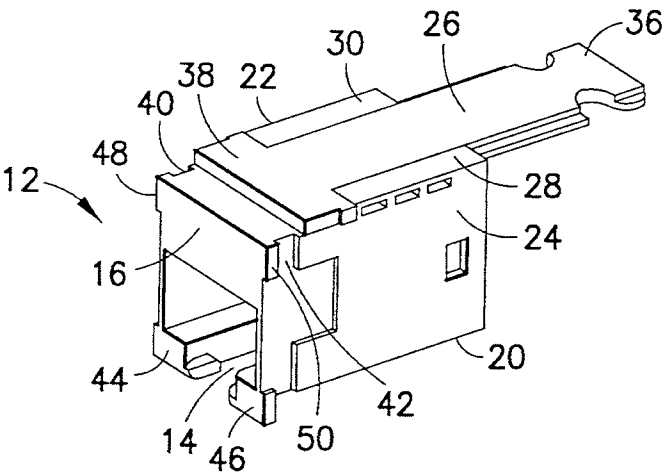
FIG. 2 is a partial side perspective view of the electrical connector assembly of FIG. 1.

As shown in FIGS. 1-3, jack housing 12 typically includes a front side 16, top side 18, bottom side 20, left side 22 and right side 24, with the jack housing 12 defining receiving space 14. In exemplary embodiments, electrical connector assembly 10 also includes a movable locking member 26. In general, movable locking member 26 is an elongated member that is configured and dimensioned to be releasably secured or attached (e.g., held in place with friction) to jack housing 12. Movable locking member 26 typically includes locking tabs 33, 35 positioned on a distal locking head 38 of movable locking member 26.

For example, in one embodiment jack housing 12 includes locking member rails or extensions 28, 30 on top side 18 of jack housing 12 that are configured and dimensioned to allow movable locking member 26 to be releasably secured or attached to the top side 18 of jack housing 12. As shown in FIGS. 1-3, rails 28, 30 allow movable locking member 26 to slide or move along a portion of top side 18, with rail extensions 32, 34 of movable locking member 26 traveling or sliding underneath at least a portion of rails 28, 30 of top side 18. In this way, movable locking member 26 is inserted or secured to top side 18 by sliding the proximal end 36 of movable locking member 26 from the front side 16 and along the top side 18 of jack housing 12 until the rail extensions 32, 34 are positioned at least in part underneath rails 28, 30 of top side 18. Once movable locking member 26 is so positioned (FIG. 2), rails 28, 30 releasably secure movable locking member 26 to top side 18, and also allow movable locking member 26 to travel along the top side 18 of jack housing 12, with the rail extensions 32, 34 moving or sliding underneath rails 28, 30. As shown in FIG. 2, locking head 38 of movable locking member 26 prevents movable locking member 26 from moving proximally past the point where locking head 38 engages rails 28, 30 of top side 18.

As depicted in FIGS. 1-3, left side 22 of jack housing 12 typically includes at least one groove 40, and right side 24 of jack housing 12 typically includes at least one groove 42. Grooves 40, 42 typically extend along sides 22, 24 from top side 18 to bottom side 20 of jack housing 12, although the present disclosure is not limited thereto.

In exemplary embodiments, front side 16 of jack housing 12 includes at least one flange extending from front side 16. In one embodiment and as shown in FIGS. 1-3, front side 16 includes lower flanges 44, 46 and upper flanges 48, 50 extending from front side 16. Lower flange 44 typically extends sideways outwardly past left side 22 and downwardly below bottom side 20. Lower flange 46 typically extends sideways outwardly past right side 24 and downwardly below bottom side 20. Upper flange 48 typically extends sideways outwardly past left side 22, and upper flange 50 typically extends sideways outwardly past right side 24.

In an exemplary embodiment and as shown in FIGS. 1 and 3, electrical connector assembly 10 includes a receiver member or panel member 52. Exemplary receiver member 52 takes the form of a jack panel (e.g., single-gang or multi-gang jack panel member) although the present disclosure is not limited thereto. Rather, receiver member 52 may take a variety of forms (e.g., a bezel-type receiver member 152 for a faceplate, as discussed below). In general, receiver member 52 is configured and dimensioned to define at least one receiving cavity 54 that is adapted to receive and/or releasably secure or lock a jack housing 12. As shown in FIGS. 1 and 3, receiver member 52 defines a plurality of receiving cavities 54, with each receiving cavity 54 adapted to receive and/or releasably secure or lock a jack housing 12.

Receiving cavity 54 of receiver member 52 typically includes at least one side projection and at least one bottom projection. In an exemplary embodiment and as shown in FIGS. 1 and 3, receiver member 52 includes two side projections 56, 58 and two bottom projections 60, 62. In exemplary embodiments and as shown in FIGS. 1-3, side projections 56, 58 and bottom projections 60, 62 are configured and dimensioned to allow at least a portion of jack housing 12 to be inserted or positioned within receiving cavity 54 when releasably secured movable locking member 26 is moved to a position away from the front side 16 of jack housing 12 (as shown in FIG. 2). In other words, when movable locking member 26 is moved to a position away from the front side 16 (FIG. 2), at least a portion of jack housing 12 may be inserted or positioned within receiving cavity 54. More specifically, when top side 18 of jack housing 12 is positioned near the top wall 64 of receiving cavity 54, side projections 56, 58 and bottom projections 60, 62 are configured and dimensioned to allow the upper flanges 48, 50 and lower flanges 44, 46 of jack housing 12 to bypass the respective side projections 56, 58 and bottom projections 60, 62 of receiving cavity 54 when movable locking member 26 is moved to a position away from the front side 16 (and the top side 18 of jack housing 12 is positioned near the top wall 64 of receiving cavity 54) as jack housing 12 is inserted or positioned (e.g., advanced distally with respect to FIG. 1) within receiving cavity 54.

Once jack housing 12 has been moved to this above-noted position with the top side 18 near the top wall 64 and with the upper flanges 48, 50 positioned distally in front of and above the side projections 56, 58 and with the lower flanges 44, 46 positioned distally in front of and above the bottom projections 60, 62, the side projection 56 is thereby positioned in groove 40 of the left side 22 of jack housing 12 and side projection 58 is thereby positioned in groove 42 of the right side of jack housing 12. As such, jack housing 12 may then be moved or slid downwardly, with side projection 56 moving or sliding in groove 40 and side projection 58 moving or sliding in groove 42, until the jack housing 12 is moved to a position where at least a portion of lower flange 44 is directly distally in front of and/or in locking engagement with bottom projection 60 and at least a portion of lower flange 46 is directly distally in front of and/or in locking engagement with bottom projection 62, and where at least a portion of upper flange 48 is directly distally in front of and/or in locking engagement with at least a portion of side projection 56 and at least a portion of upper flange 50 is directly distally in front of and/or in locking engagement with at least a portion of side projection 58 (alternatively, upper flanges 48, 50 need not be distally in front of and/or in locking engagement with side projections 56, 58 when the housing 12 is in such a position). After the jack housing 12 has moved to this position, the movable locking member 26 may then be advanced distally towards the receiver member 52 until the locking head 38 and/or locking tabs 33, 35 of the movable locking member 26 lockingly engage the receiver member 52 and/or housing 12 to releasably lock or secure the jack housing 12 within or with respect to the receiver member 52, as best shown in FIG. 3. In one embodiment, after distally advancing the movable locking member 26 to secure the jack housing 12, the front sides of the jack housing 12 and the locking member 26 are substantially flush with one another.

In exemplary embodiments, top side 18 of jack housing 12 includes a recess 13 or the like (e.g., a small recess integrated in the proximal portion of top side 18) that is configured and dimensioned to engage a tab or protrusion (obscured) on the bottom side of movable locking member 26 when the movable locking member has been distally advanced to secure the jack housing 12 within or with respect to the receiver member 52 (FIG. 3). Such engagement of the tab or protrusion of movable locking member 26 with recess 13 of top side 18 further locks/secures jack housing 12 within or with respect to the receiver member 52, and prevents movable locking member 26 from being easily disengaged from receiver member 52 and/or housing 12. The tab or protrusion of movable locking member 26 may be disengaged from the recess 13 by lifting the movable locking member 26 upwards to thereby then allow a user to move the movable locking member proximally (e.g., to move or slide member 26 proximally to the position as shown in FIG. 2 to release or unlock jack housing 12 from receiver member 52).

In general, after distally advancing the movable locking member 26 to secure the jack housing 12, the engaged locking head 38 and/or the engaged locking tabs 33, 35 prevent the side projections 56, 58 from moving in the grooves 40, 42, and also prevent the jack housing 12 from being removed (e.g., distally or proximally) from the receiver member 52. Moreover, the proximal edges of grooves 40, 42 may also prevent jack housing 12 from being removed (e.g., distally) from the receiver member 52 (e.g., via engagement with side projections 56, 58). Also, the lower flanges 44, 46 engaged with bottom projections 60, 62 and the upper flanges 48, 50 engaged with side projections 56, 58 prevent the jack housing 12 from being removed (e.g., distally or proximally) from the receiver member 52. As noted above, in an alternative embodiment, upper flanges 48, 50 need not be engaged with side projections 56, 58 (e.g., upper flanges 48, 50 may be in engaging contact with other portions of receiver member 52).

To release or unlock jack housing 12 from receiver member 52, first the movable locking member 26 is moved or slid proximally to the position as shown in FIG. 2. The jack housing 12 may then be moved upwardly (with the side projections 56, 58 traveling in grooves 40, 42) so that the lower flanges 44, 46 are above the bottom projections 60, 62 and the upper flanges 48, 50 are above the side projections 56, 58 so that the jack housing may then be moved proximally out of engagement with and away from the receiver member 52.

In exemplary embodiments and as shown in FIGS. 1-3, movable locking member 26 is an elongated member having a proximal end 36. By having the proximal end 36 extend from jack housing 12, this enables an operator or technician to quickly and easily move the movable locking member in either direction (e.g., proximally or distally): Therefore, this advantageously allows an operator or technician to quickly and easily secure/attach or unsecure/unattach the jack housing 12 from the receiver member 52, even when under difficult conditions (e.g., in the field; When the jack housing 12 is located in a tight and/or limited workspace; and/or when it is next to and/or adjacent to multiple adjacent jack assemblies/housings, media, connectors/plug combinations, etc.).

Moreover, the proximal end 36 of movable locking member 26 may be dipped or coated or the like with a user-friendly material (e.g., nylon) and/or color (e.g., bright colors) to further enhance and facilitate its ease of use by technicians/operators. In addition, the elongated movable locking member 26, and more particularly, the proximal end 36, may include cable management functionality for convenient and efficient cable access as desired. For example, locking member 26 and/or proximal end 36 may include or be operatively associated with cable management guide structures or the like, cable accommodating spools or the like, etc. In another embodiment, movable locking member 26 (e.g., proximal end 36) may include or be integrated with a cable strain relief member or the like. For example, the cable strain relief member is configured and dimensioned to bend down and clamp/attach on a cable (e.g., a cable exiting jack housing 12), thereby providing a further locking for the movable locking member 26 (e.g., after the movable locking member 26 has been distally advanced to secure the jack housing 12 within or with respect to the receiver member 52), as well as providing strain relief for the attached cable.

As shown in FIGS. 1-3, exemplary movable locking member 26 takes the form of an elongated locking member. However, movable locking member 26 may take a variety of other forms. For example, movable locking member 26 may include a top side, a right side, a left side and/or a bottom side, and any combination thereof. For example, movable locking member 26 may include a top side, a right side and a left side, with the top side, left side and/or right side forming or defining at least a portion of jack housing 12. In one embodiment, movable locking member 26 forms or defines a substantial portion or section of jack housing 12 (e.g., to provide shielding functionality to the jack housing 12 and/or assembly 10).

Figure 4:
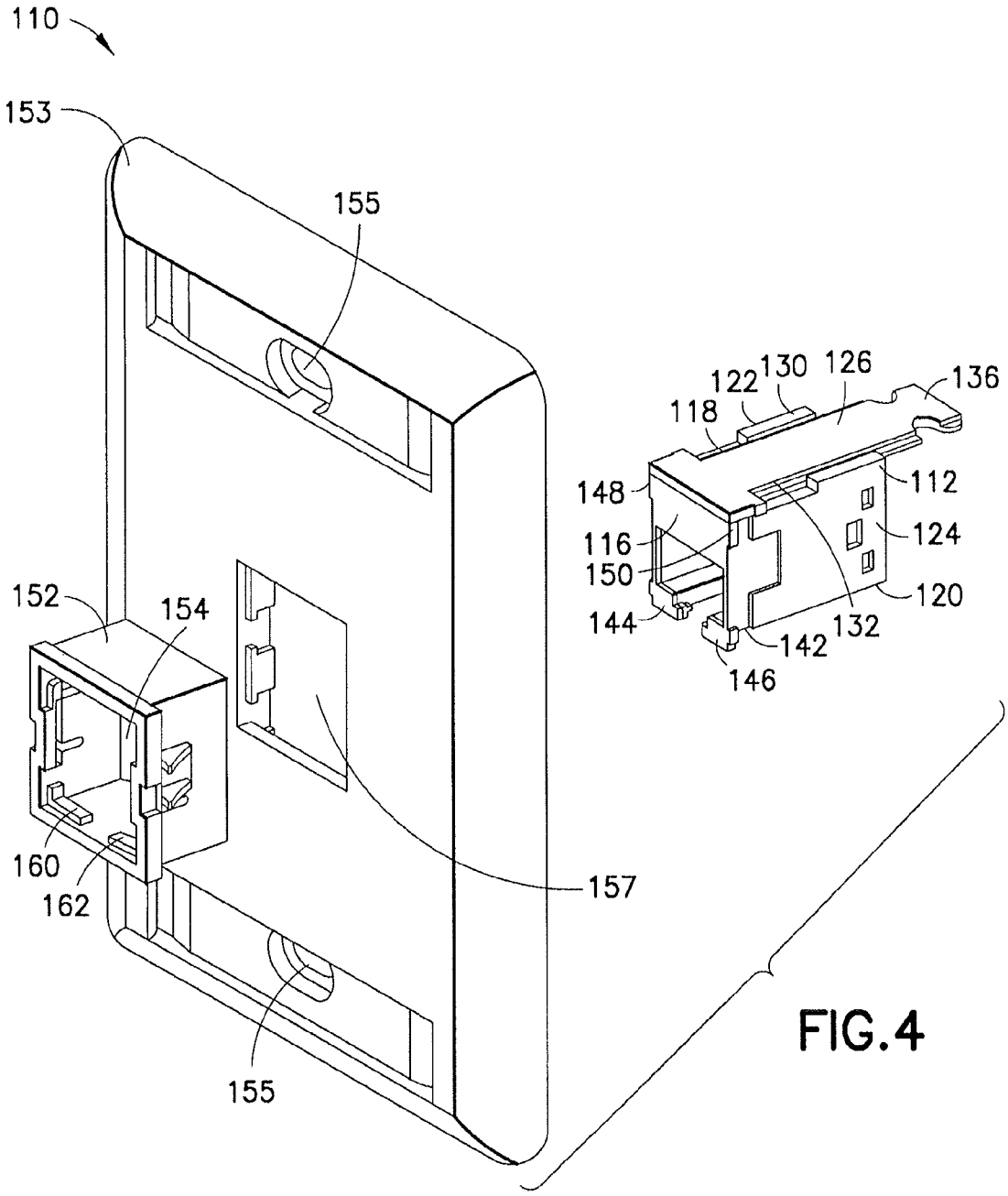
FIG. 4 is a side perspective view of an electrical connector assembly in accordance with another exemplary embodiment of the present disclosure, prior to assembly.
Figure 5:
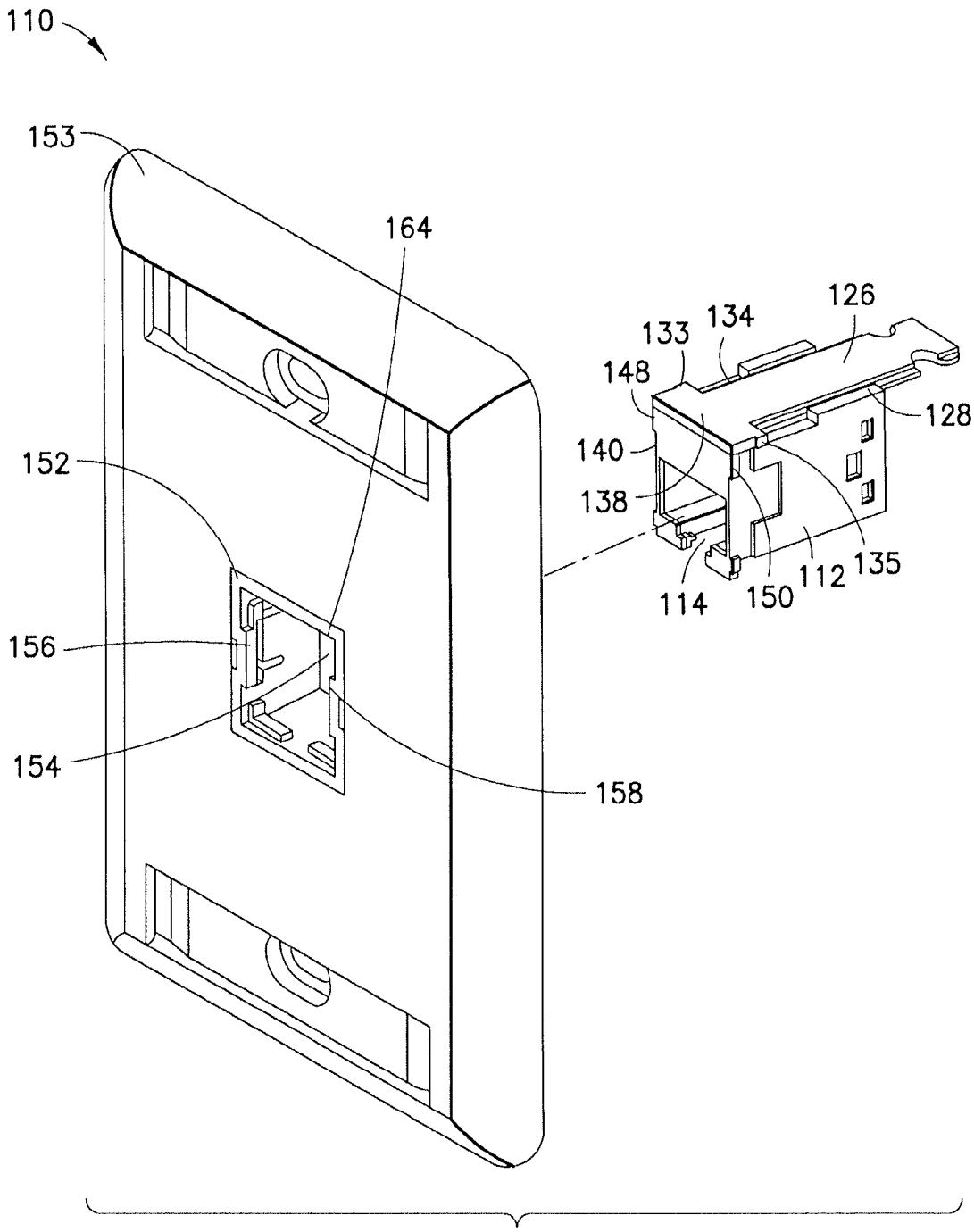
FIG. 5 is a side perspective view of the electrical connector assembly of FIG. 4, prior to assembly.
Figure 6:
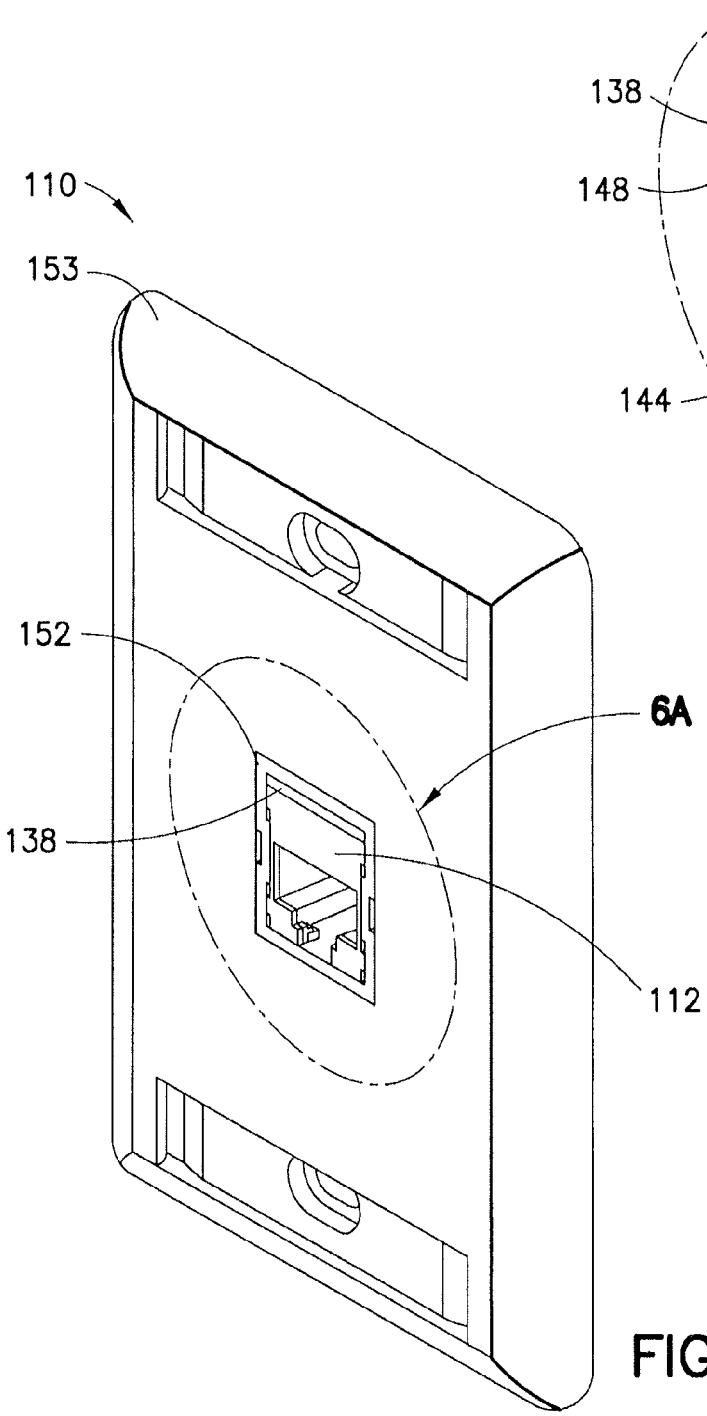
FIG. 6 is a side perspective view of the electrical connector assembly of FIG. 4, after assembly.

In an alternative embodiment of the present disclosure and as depicted in FIGS. 4-6, electrical connector assembly 110 includes a jack housing 112 (e.g., high density modular communication jack housing) that is adapted to receive signals from a mating connecting assembly (e.g., plug connector) inserted or introduced to a receiving space 114 of jack housing 112. In general, associated contacts (e.g., eight contacts) or the like of jack housing 112 are positioned for electrical communication with data signal transmission media plug elements/contacts introduced to the receiving space 114.

As shown in FIGS. 4-6, jack housing 112 typically includes a front side 116, top side 118, bottom side 120, left side 122 and right side 124, with jack housing 112 defining receiving space 114. Electrical connector assembly 110 typically also includes a movable locking member 126. Similar to member 26, movable locking member 126 is typically an elongated member that is configured and dimensioned to be releasably secured or attached (e.g., held in place with friction) to jack housing 112. Movable locking member 126 typically includes locking tabs 133, 135 positioned on a distal locking head 138.

In one embodiment jack housing 112 includes locking member rails or extensions 128, 130 on top side 118 that are configured and dimensioned to allow movable locking member 126 to be releasably secured/attached to top side 118. In general, rails 128, 130 allow movable locking member 126 to slide or move along a portion of top side 118, with rail extensions 132, 134 of movable locking member 126 traveling or sliding underneath at least a portion of rails 128, 130. For example, movable locking member 126 may be inserted or secured to top side 118 by sliding the proximal end 136 of movable locking member 126 from the front side 116 and along the top side 118 until rail extensions 132, 134 are positioned at least in part underneath rails 128, 130. Once member 126 is so positioned (FIGS. 4-5), rails 128, 130 releasably secure movable locking member 126 to top side 118, and also allow movable locking member 126 to travel along the top side 118 with the rail extensions 132, 134 moving or sliding underneath rails 128, 130. Locking head 138 typically prevents movable locking member 126 from moving proximally past the point where locking head 138 engages rails 128, 130 of top side 118.

Left side 122 of jack housing 112 typically includes at least one groove 140, and right side 124 of jack housing 112 typically includes at least one groove 142. In one embodiment, grooves 140, 142 extend along sides 122, 124 from top side 118 to bottom side 120.

Similar to jack housing 12, front side 116 of jack housing 112 typically includes at least one flange extending from front side 116. In one embodiment, front side 116 includes lower flanges 144, 146 and upper flanges 148, 150 extending from front side 116. Lower flange 144 typically extends sideways outwardly past left side 122 and downwardly below bottom side 120. Lower flange 146 typically extends sideways outwardly past right side 124 and downwardly below bottom side 120. Upper flange 148 typically extends sideways outwardly past left side 122, and upper flange 150 typically extends sideways outwardly past right side 124.

In general and as shown in FIGS. 4-6, electrical connector assembly 110 includes a receiver member 152. Exemplary receiver member 152 takes the form of a bezel or bezel-type receiver member 152 for a faceplate 153 (e.g., a wall-mounted faceplate or workstation outlet 153), although the present disclosure is not limited thereto. Rather, receiver member 152 may take a variety of forms. Faceplate 153 typically is adapted to accommodate adapters/receptacles and the like suitable for connecting various electrical and cable communication lines. Faceplate 153 may also be suitable for behind-the-wall cable/equipment installations and/or management. Faceplate 153 typically includes at least one wall (or like structure) mounting element 155 (e.g., fastener hole) configured to receive a wall engaging element.

Exemplary receiver member 152 (e.g., bezel) is configured and dimensioned to be inserted into a receiving space 157 of faceplate 153. In one embodiment (FIG. 4), receiver member 152 is inserted from the front side of faceplate 153 and advanced proximally towards receiving space 157 until member 152 is secured into space 157 (e.g., member 152 may snap-fit into space 157 from the front). Receiver member 152 may or may not have jack housing 112 secured within receiver member 152 when receiver member 152 is inserted into receiving space 157. In one embodiment, the front side of receiver member 152 is substantially flush with the front side of faceplate 153 after the receiver member 152 has been inserted into space 157.

In general, receiver member 152 is configured and dimensioned to define at least one receiving cavity 154 that is adapted to receive and/or releasably secure or lock a jack housing 112. It is noted that receiver member 152 may define a plurality of receiving cavities 154, with each receiving cavity 154 adapted to receive and/or releasably secure or lock a jack housing 112.

Receiving cavity 154 of receiver member 152 typically includes at least one side projection and at least one bottom projection. In an exemplary embodiment, receiver member 152 includes two side projections 156, 158 and two bottom projections 160, 162. Side projections 156, 158 and bottom projections 160, 162 are typically configured and dimensioned to allow at least a portion of jack housing 112 to be inserted or positioned within receiving cavity 154 when releasably secured movable locking member 126 is moved to a position away from the front side 116 of jack housing 112. As such, when movable locking member 126 is moved to a position away from the front side 116, at least a portion of jack housing 112 may be inserted or positioned within receiving cavity 154. More specifically, when top side 118 is positioned near the top wall 164 of receiving cavity 154, side projections 156, 158 and bottom projections 160, 162 are configured and dimensioned to allow the upper flanges 148, 150 and lower flanges 144, 146 of jack housing 112 to bypass the respective side projections 156, 158 and bottom projections 160, 162 of receiving cavity 154 when movable locking member 126 is moved to a position away from the front side 116 (and top side 118 of jack housing 112 is positioned near top wall 164 of receiving cavity 154) as jack housing 112 is inserted or positioned (e.g., advanced distally with respect to FIG. 4) within receiving cavity 154.

Figure 6A:
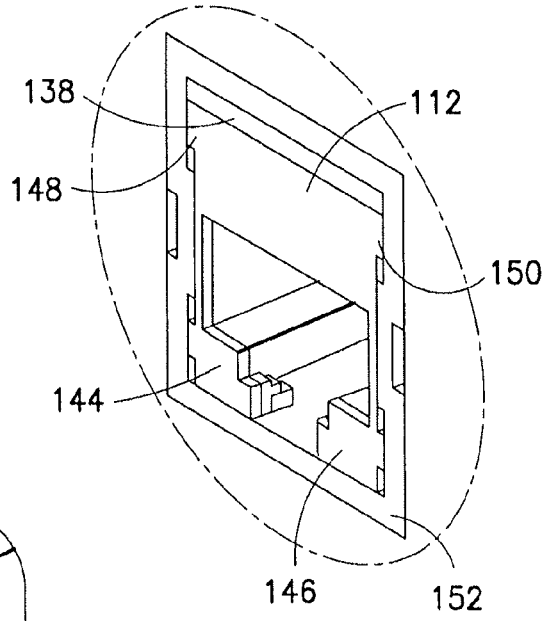
FIG. 6A is a partial exploded side perspective view of the electrical connector assembly of FIG. 4, after assembly.

Once jack housing 112 has been moved to this above-noted position with the top side 118 near the top wall 164 and with the upper flanges 148, 150 positioned distally in front of (at least a portion of) and above the side projections 156, 158 and with the lower flanges 144, 146 positioned distally in front of and above the bottom projections 160, 162, at least a portion of side projection 156 is thereby positioned in groove 140 of the left side 122 of jack housing 112 and at least a portion of side projection 158 is thereby positioned in groove 142 of the right side of jack housing 112. As such, jack housing 112 may then be moved or slid downwardly, with side projection 156 moving or sliding in groove 140 and side projection 158 moving or sliding in groove 142, until the jack housing 112 is moved to a position where at least a portion of lower flange 144 is directly distally in front of and/or in locking engagement with bottom projection 160 and at least a portion of lower flange 146 is directly distally in front of and/or in locking engagement with bottom projection 162, and where at least a portion of upper flange 148 is directly distally in front of and/or in locking engagement with at least a portion side projection 156 and at least a portion of upper flange 150 is directly distally in front of and/or in locking engagement with at least a portion of side projection 158 (alternatively, upper flanges 148, 150 need not be distally in front of and/or in locking engagement with side projections 156, 158 when the housing 112 is in such a position). After the jack housing 112 has moved to this position, the movable locking member 126 may then be advanced distally towards the receiver member 152 until the locking head 138 and/or locking tabs 133, 135 of the movable locking member 126 lockingly engage the receiver member 152 and/or housing 112 to releasably lock or secure the jack housing 112 within or with respect to the receiver member 152, as best shown in FIGS. 6 and 6A. In one embodiment, after distally advancing the movable locking member 126 to secure the jack housing 112, the front sides of the jack housing 112 and the locking member 126 are substantially flush with one another (and with the front side of faceplate 153, as shown in FIGS. 6 and 6A).

In exemplary embodiments, top side 118 of jack housing 112 includes a recess or the like (e.g., a small recess integrated in the proximal portion of top side 118) that is configured and dimensioned to engage a tab or protrusion on the bottom side of movable locking member 126 when the movable locking member has been distally advanced to secure the jack housing 112 within or with respect to the receiver member 152 (FIG. 6). Such engagement of the tab or protrusion of movable locking member 126 with recess of top side 118 furtherlocks/secures jack housing 112 within or with respect to the receiver member 152, and prevents movable locking member 126 from being easily disengaged from receiver member 152 and/or housing 112. The tab or protrusion of movable locking member 126 may be disengaged from the recess by lifting the movable locking member 126 upwards to thereby then allow a user to move the movable locking member 126 proximally (e.g., to move or slide member 126 proximally to release or unlock jack housing 112 from receiver member 152).

In general, after distally advancing movable locking member 126 to secure the jack housing 112, the engaged locking head 138 and/or the engaged locking tabs 133, 135 prevent the side projections 156, 158 from moving in the grooves 140, 142, and also prevent the jack housing 112 from being removed (e.g., distally or proximally) from the receiver member 152. Moreover, the proximal edges of grooves 140, 142 may also prevent jack housing 112 from being removed (e.g., distally) from the receiver member 152 (e.g., via engagement with side projections 156, 158). Also, the lower flanges 144, 146 engaged with bottom projections 160, 162 and the upper flanges 148, 150 engaged with side projections 156, 158 prevent the jack housing 112 from being removed (e.g., distally or proximally) from the receiver member 152. As noted above, in an alternative embodiment, upper flanges 148, 150 need not be engaged with side projections 156, 158 (e.g., upper flanges 148, 150 may be in engaging contact with other portions of receiver member 152).

To release or unlock jack housing 112 from receiver member 152, first the movable locking member 126 is moved or slid proximally until the locking head engages or is adjacent to rails 128, 130. The jack housing 112 may then be moved upwardly (e.g., with the side projections 156, 158 traveling in grooves 140, 142) so that the lower flanges 144, 146 are above the bottom projections 160, 162 and the upper flanges 148, 150 are above the side projections 156, 158 so that the jack housing 112 may then be moved proximally out of engagement with and away from the receiver member 152.

Similar to member 26, movable locking member 126 may be an elongated member having a proximal end 136. By having the proximal end 136 extend from jack housing 112, this enables an operator or technician to quickly and easily move the movable locking member 126 in either direction (e.g., proximally or distally). Therefore, this advantageously allows an operator to quickly and easily secure/attach or unsecure/unattach the jack housing 112 from the receiver member 152, even when under difficult conditions (e.g., in the field; when the jack housing 112 is located in a tight and/or limited workspace; and/or when it is next to and/or adjacent to multiple adjacent jack assemblies/housings, media, connectors/plug combinations, etc.).

Moreover, the proximal end 136 of movable locking member 126 may be dipped or coated or the like with a user-friendly material (e.g., nylon) and/or color (e.g., bright colors) to further enhance and facilitate its ease of use by technicians/operators. In addition, the elongated movable locking member 126, and more particularly, the proximal end 136, may include cable management functionality for convenient and efficient cable access as desired. For example, locking member 126 and/or proximal end 136 may include or be operatively associated with cable management guide structures or the like, cable accommodating spools or the like, etc. In another embodiment, movable locking member 126 (e.g., proximal end 136) may include or be integrated with a cable strain relief member or the like. For example, the cable strain relief member is configured and dimensioned to bend down and clamp/attach on a cable (e.g., a cable exiting jack housing 112), thereby providing a further locking for the movable locking member 126 (e.g., after the movable locking member 126 has been distally advanced to secure the jack housing 112 within or with respect to the receiver member 152), as well as providing strain relief for the attached cable.

Exemplary movable locking member 126 takes the form of an elongated locking member. However, movable locking member 126 may take a variety of other forms. For example, movable locking member 126 may include a top side, a right side, a left side and/or a bottom side, and any combination thereof. For example and similar to member 26, movable locking member 126 may include a top side, a right side and a left side, with the top side, left side and/or right side forming or defining at least a portion of jack housing 112. In one embodiment, movable locking member 126 forms or defines a substantial portion or section of jack housing 112 (e.g., to provide shielding functionality to the jack housing 112 and/or assembly 110).

Although the systems, assemblies and methods of the present disclosure have been described with reference to exemplary embodiments thereof, the present disclosure is not limited to such exemplary embodiments and/or implementations. Rather, the systems, assemblies and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. An electrical connector assembly comprising:

a housing defining a front side and a top side;

a movable locking member releasably secured to the side of the housing, the movable locking member including a distal locking head that extends substantially across the top side of the housing from one end to the other end, the locking head having a first end including a first locking tab and a second end including a second locking tab;

wherein the movable locking member is configured and dimensioned to be moved away from the front side to allow the housing to be moved to a first position within a receiving cavity of a receiver member;

wherein the movable locking member is configured and dimensioned to be moved towards the front side of the housing to secure the housing within the receiving cavity after the housing has moved to a second position within the receiving cavity;

wherein the first and second locking tabs lockingly engage with the receiver member after the movable locking member has moved towards the front side of the housing to secure the housing within the receiving cavity, wherein the first and second locking tabs prevent the locking member from being unsecured from the top side of the housing when the locking member is moved away from the front side of the housing, wherein the housing further includes a first flange extending from a side thereof and the receiver member further includes a first projection, the first flange configured and dimensioned to bypass the first projection when the housing is moved to the first position; and wherein the first flange is lockingly engaged with the first projection when the housing is in the second position.

2. The assembly of claim 1, wherein the housing further includes left and right sides, the left and right sides each including a groove; and wherein the receiver member further includes first and second projections, the first projection positioned in the right side groove and the second projection positioned in the left side groove when the housing is in the first position.

3. The assembly of claim 2, wherein the first and second projections travel within the right and left side grooves when the housing is moved from the first position to the second position.

4. The assembly of claim 1, wherein the front side of the housing further includes a second flange extending from the front side and the receiver member further includes a second projection; and wherein the second flange is positioned to bypass the second projection when the housing is in the first position; and wherein the second flange is lockingly engaged with the second projection when the housing is in the second position.

5. The assembly of claim 4, wherein the front side of the housing further includes a third flange and a fourth flange extending from the front side and the receiver member further includes a third projection and a fourth projection; and wherein the third flange is positioned to bypass the third projection and the fourth flange is positioned to bypass the fourth projection when the housing is in the first position; and wherein the third flange is lockingly engaged with the third projection and the fourth flange is lockingly engaged with the fourth projection when the housing is in the second position.

6. The assembly of claim 1, wherein the top side includes first and second rails and the movable locking member includes first and second rail extensions; and wherein the movable locking member is releasably secured to the housing by inserting the first and second rail extensions into the first and second rails.

7. The assembly of claim 6, wherein the movable locking member moves via the rail extensions moving with respect to the first and second rails.

8. The assembly of claim 1, wherein the front side of the housing and the movable locking member are substantially flush after the movable locking member has moved towards the front side of the housing to secure the housing within the receiving cavity.

9. The assembly of claim 1, wherein the housing is a high density modular communication jack housing that defines a receiving space, the receiving space adapted to receive signals from a connecting assembly inserted into the receiving space.

10. The assembly of claim 1, wherein the receiver member is a bezel, the bezel configured and dimensioned to be positioned in a faceplate or workstation outlet.

11. The assembly of claim 1, wherein the housing is a jack housing and the receiver member is a panel member, the panel member having a plurality of receiving cavities, each receiving cavity configured and dimensioned to releasably secure a jack housing.

12. The assembly of claim 1, wherein the movable locking member is elongated having an elongated proximal end.

13. The assembly of claim 12, wherein the elongated proximal end includes gripping material or coating.

14. The assembly of claim 1, wherein the movable locking member defines a portion of the housing.

15. The assembly of claim 1, wherein the housing further includes a left side, right side and a bottom side, and the first flange extends: (i) sideways outwardly past the left or right side, and (ii) downwardly below the bottom side.

16. The assembly of claim 4, wherein the housing further includes a left side and a right side, and the second flange extends sideways outwardly past the left or right side.

17. The assembly of claim 1, wherein a tab of the movable locking member releasably engages a recess of the housing when the movable locking member is moved to the front side of the housing to secure the housing within the receiving cavity.

18. A method for removably locking an electrical connector assembly comprising:

providing a housing defining a front side and a top side;

releasably securing a movable locking member to the top side of the housing, the movable locking member including a distal locking head that extends substantially across the top side of the housing from one end to the other end, the locking head having a first end including a first locking tab and a second end including a second locking tab;

moving the movable locking member away from the front side of the housing;

moving the housing to a first position within a receiving cavity of a receiver member;

moving the housing to a second position within the receiving cavity; and moving the movable locking member towards the front side of the housing to secure the housing within the receiving cavity;

wherein the first and second locking tabs locking engage with the receiver member after the movable locking member has moved towards the front side of the housing to secure the housing within the receiving cavity; and wherein the first and second locking tabs prevent the locking member from being unsecured from the top side of the housing when the locking member is moved away from the front side of the housing;

wherein the housing further includes a first flange extending from a side thereof and the receiver member further includes a first projection, the first flange positioned to bypass the first projection when the housing is moved to the first position; and wherein the first flange is lockingly engaged with the first projection when the housing is in the second position.

19. The method of claim 18, wherein the housing further includes left and right sides, the left and right sides each including a groove; and wherein the receiver member further includes second and third projections, the second projection positioned in the right side groove and the third projection positioned in the left side groove when the housing is in the first position.

20. The method of claim 19, wherein the second and third projections travel within the right and left side grooves when the housing is moved from the first position to the second position.

21. The method of claim 18, wherein the front side of the housing further includes a second flange extending from the front side and the receiver member further includes a second projection; and wherein the second flange is positioned to bypass the second projection when the housing is in the first position; and wherein the second flange is lockingly engaged with the second projection when the housing is in the second position.

22. The method of claim 21, wherein the front side of the housing further includes a third flange and a fourth flange extending from the front side and the receiver member further includes a third projection and a fourth projection; and wherein the third flange is positioned to bypass the third projection and the fourth flange is positioned to bypass the fourth projection when the housing is in the first position; and wherein the third flange is lockingly engaged with the third projection and the fourth flange is lockingly engaged with the fourth projection when the housing is in the second position.

23. The method of claim 18, wherein the top side includes a first and second rails and the movable locking member includes first and second rail extensions; and wherein the movable locking member is releasably secured to the housing by inserting the first and second rail extensions into the first and second rails.

24. The method of claim 23, wherein the movable locking member moves via the rail extensions moving with respect to the first and second rails.

25. The method of claim 18, wherein the front side of the housing and the movable locking member are substantially flush after the movable locking member has moved towards the front side of the housing to secure the housing within the receiving cavity.

26. The method of claim 18, wherein the housing is a high density modular communication jack housing that defines a receiving space, the receiving space adapted to receive signals from a connecting assembly inserted into the receiving space.

27. The method claim 18, wherein a tab of the movable locking member releasably engages a recess of the housing when the movable locking member is moved to the front side of the housing to secure the housing within the receiving cavity.

28. An electrical connector assembly comprising:

a housing defining a front side, top side, left side and right side, the front side including a first flange extending from the front side and the left and right sides each including a groove;

a movable locking member releasably secured to the top side of the housing, the movable locking member including a distal locking head that extends substantially across the top side of the housing from one end to the other end, the locking head having a first end including a first locking tab and a second end including a second locking tab;

wherein the movable locking member is configured and dimensioned to be moved away from the front side to allow the housing to be moved to a first position within a receiving cavity of a receiver member, the receiver member having a first projection, a second projection and a third projection, the first flange configured and dimensioned to bypass the first projection when the housing is moved to the first position and the second projection positioned in the right side groove and the third projection positioned in the left side groove when the housing is in the first position;

wherein the movable locking member is configured and dimensioned to be moved towards the front side of the housing to secure the housing within the receiving cavity after the housing has moved towards the first projection to a second position within the receiving cavity, the first flange lockingly engaged with the first projection when the housing is in the second position to prevent the housing from being removed from the receiving cavity;

wherein the first and second locking tabs lockingly engage with the receiver member after the movable locking member has moved towards the front side of the housing to secure the housing within the receiving cavity; and wherein the first and second locking tabs prevent the locking member from being unsecured from the top side of the housing when the locking member is moved away from the front side of the housing.

29. The assembly of claim 28, wherein the second and third projections travel within the right and left side grooves when the housing is moved from the first position to the second position.

* * * * *